250-506.1 SR
5/5/87 OR 4,663,533

United States Patent [19]

Kok et al.

[11] Patent Number: 4,663,533

[45] Date of Patent: May 5, 1987

[54] STORAGE AND SHIPPING CASK FOR SPENT NUCLEAR FUEL

[75] Inventors: Kenneth D. Kok, Dublin; Richard J. Burian, Lancaster, both of Ohio

[73] Assignee: Battelle Memorial Institute, Columbus, Ohio

[21] Appl. No.: 565,450

[22] Filed: Dec. 27, 1983

[51] Int. Cl.[4] ..... F28F 5/00; G21F 5/00

[52] U.S. Cl. ..... 250/506.1; 250/518.1

[58] Field of Search ..... 250/506.1, 518.1

[56] References Cited

U.S. PATENT DOCUMENTS

| | | | |
|---|---|---|---|
| 3,016,463 | 1/1982 | Needham | 250/506.1 |
| 3,114,839 | 12/1963 | Peters | 250/518.1 |
| 4,156,147 | 5/1979 | Naum | 250/515.1 |
| 4,232,730 | 11/1980 | Reese | 250/506.1 |
| 4,272,683 | 6/1981 | Baatz | 250/506.1 |

OTHER PUBLICATIONS

EP 0036954, 10/81.

*Primary Examiner*—Sam Silverberg
*Attorney, Agent, or Firm*—Philip M. Dunson

[57] ABSTRACT

A cylindrical cask (1) for nuclear reactor fuel comprises a bottom portion (3), a side portion (5), and a top portion (4), each comprising material for shielding against escape of electromagnetic radiation and nuclear particles and for transfer of heat as required. The side portion comprises a plurality of coaxial thin laminas (9,10,11,12), each fitting tightly against the next, and at least two of them having substantial mechanical strength and toughness for stopping the spread of any fracturing that might occur in an adjacent lamina.

14 Claims, 2 Drawing Figures

STORAGE AND SHIPPING CASK FOR SPENT NUCLEAR FUEL

FIELD

This invention relates to storage and shipping casks for spent nuclear reactor fuel. It has to do more particularly with a cylindrical cask that has coaxial members for shielding against escape of electromagnetic radiation or nuclear particles and for transfer of heat as required while providing structural strength and toughness, for resistance to fracture propagation.

BACKGROUND

Containers used for the storage or shipment of spent nuclear fuel or other radioactive material must be designed to seal in the radioactivity under possible adverse conditions that might occur during use or transport. The container walls must provide adequate shielding to block radiation and also be thermally conductive to dissipate the heat generated by the radioactive material stored within the container.

The considerations in design of storage and shipping casks involve providing a sealed pressure vessel according to applicable codes, and providing adequate thermal conductivity for dissipation of heat generated by the contained radioactive material. These considerations require containers that are constructed predominantly of metals of high strength. Additionally the containers must provide shielding against escape of electromagnetic radiation such as gamma rays. In general, this type of shielding is provided by metal of suitable thickness, with high density materials being favored. Also, the containers provide shielding against escape of nuclear particles such as neutrons. In general, this type of shielding is provided to a limited extent by the thickness of the container or distance from radioactive source to the outer surface of the container. Often the shielding effectiveness is enhanced by use of neutron absorptive and/or moderator materials such as boron carbide or a material high in hydrogen such as various hydrocarbons in combination with materials having high neutron absorption properties.

Of special importance is the need to maintain the physical integrity of the container in possible accidents. To this end, tests have been devised such as dropping the container from a height of 9 meters on a non-yielding surface. Other tests involve dropping the container from a height of 1 meter on a mandrel of defined configuration. Tests are carried out typically at about 800° C. for about thirty minutes. Various types of containers have been proposed that might approach satisfying the requirements of the above tests to varying degrees and other safety requirements that might be anticipated for extreme accident conditions.

For example, a simple design of a container for storage and shipment of radioactive material involves a cylindrical metal cup-shaped container with cover to provide an inner cylindrical cavity for the radioactive material. Such a container can be fabricated from steel by welding. It would have the required strength as a pressure vessel but would have inadequate shielding properties in reasonable thickness. Lead has the desirable properties of high absorption capability, low cost, and castability; but has low mechanical strength and a relatively low melting temperature.

Containers have been made with a laminated structure for shielding consisting of lead cast between inner and outer shells of stainless steel. Under high temperature test conditions representing possible conditions of exposure during use, there is a tendency of the lead intermediate layer to melt and flow from its proper place, resulting in the loss of its absorption effectiveness. The use of special insulation (e.g. moist plaster in the outer and intermediate layers) complicates the design and is of questionable effectiveness, particularly when the cavity contains spent nuclear fuel that can generate significant amounts of internal heat. The provision of forced coolant passages in the outer or inner shell, within the contents cavity, or the attachment of coolant tubes to the shell by welding, results in the container being susceptible to failure during the coolant cycle. Passive air-cooled designs are preferred. In addition to cooling at the outer cylindrical surface, additional connective air cooling can be provided such as by use of a centrally located annular chimney as in U.S. Pat. No. 3,111,586 of Rogers.

Other container designs have been proposed based on a cast iron shield as in U.S. Pat. No. 4,272,683 of Baatz et al. The shield can be cast around a relatively thin inner layer of drawn or welded stainless steel placed in the mold, although it is mentioned that it might be advantageous to provide the inner protective layer by other means such as galvanic coating of the cast shield. Heavy metal particles (for enhanced gamma ray absorption) and channels (for adding neutron absorbing material) are incorporated at the time of casting the shield. The problem with a unitary cast iron shield is the susceptibility to brittle fracture and crack propagation through the entire shield. Safety considerations require that the shield remain in place even under extreme conditions resulting in fracture.

In general, the prior art of casting shields has emphasized maintaining the continuum of metal or integrity of the body, presumably based on heat transfer considerations without consideration of the adverse safety aspects of fracture propagation through the structure.

DISCLOSURE

A typical storage and shipping cask according to the present invention is constructed as a cylinder in which the outer cylindrical surface or shield contains a plurality of coaxial members, such as relatively thin laminas formed by heat shrinking or explosive forming. The advantage of using several close-fitting laminas is to stop the spread of any fracturing that might occur in an adjacent member and thus maintain the physical integrity of the outer cylindrical side portion as a whole. Each lamina is selected for a functional purpose. For example, the inner and outer coaxial members can comprise steel or wrought iron or other strong and tough material that has substantial resistance to brittle fracture. One intermediate coaxial member can be cast iron, to block deleterious electromagnetic radiation therethrough, and another intermediate member can be a mixture of heat conductive material such as ferrous material and a material such as polyethylene, to block penetration of nuclear particles therethrough. An intermediate member can comprise steel or wrought iron or other strong and tough material that has substantial resistance to brittle fracture and can arrest crack propagation in other coaxial members.

The spent nuclear fuel or other radioactive material is positioned within the cylinder or fuel cavity of the cask, which is provided with a bottom and a top cover. For storage and transport of some spent fuels, depending on the level of decay, it may be desirable to provide an additional heat transfer surface other than the outer cylindrical surface and the fuel cavity is designed as an annular cavity with an inner cylindrical surface forming a centrally located chimney for convective cooling, with inner air passages provided in the bottom closure of the cask. The chimney can contain a thermally conductive spider to provide additional heat transfer surface area compared to the cylindrical surface area of the inner cylinder. The outer cylindrical surface may be smooth or it may have cooling fins formed integrally with the outer coaxial member or attached to the outer cylindrical surface in a semi-permanent or permanent manner by a variety of known means, depending on the requirements for heat transfer.

DRAWINGS

CARRYING OUT THE INVENTION

Figure 1:
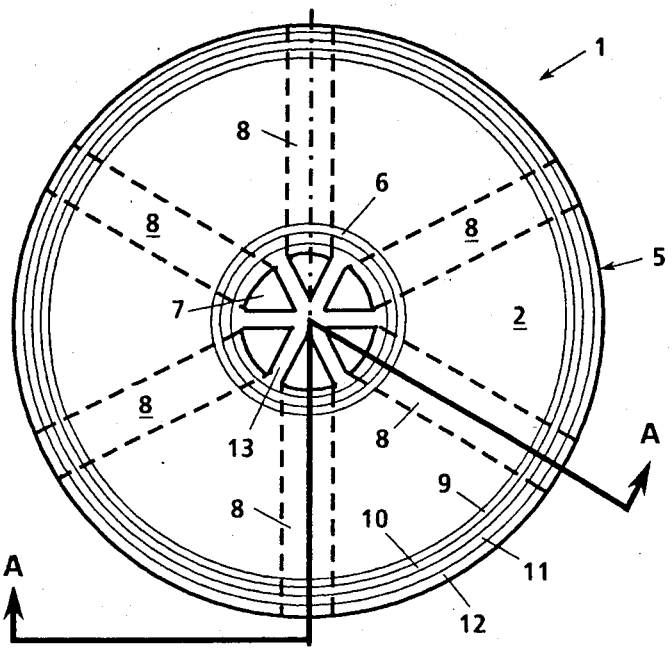
FIG. 1 is a top view of a typical cylindrical container according to the present invention with the top cover removed.
Figure 2:
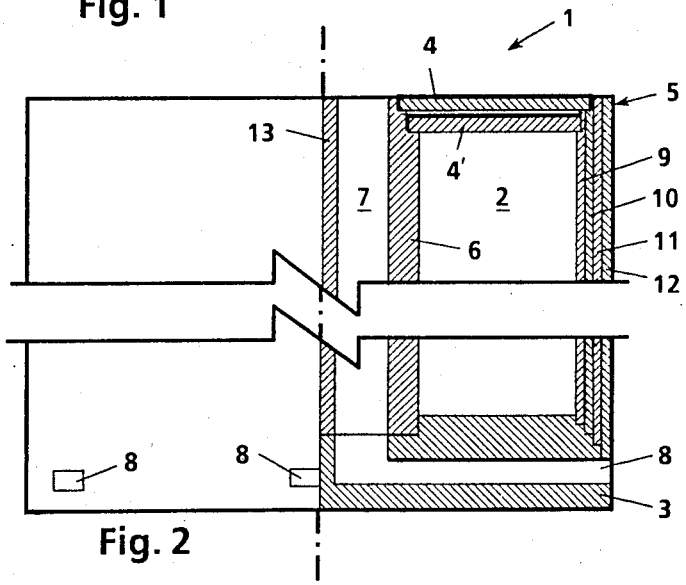
FIG. 2 is a vertical sectional view, as indicated at A—A in FIG. 1, of the container with the top cover in place.

As shown in FIG. 1, a typical container according to the present invention for storage and transport of nuclear fuel comprises a cylindrical container 1 having an annular cavity 2 to contain the radioactive material. As shown in FIG. 2, the container comprises a bottom portion 3, a top portion 4, and a side portion 5, comprising material for shielding against escape of electromagnetic radiation and nuclear particles and for transfer of heat as required.

Typically, the outer cylinder 5 forming the shield comprises a plurality of coaxial members 9,10,11,12, each fitting tightly against the next, and at least two of them having substantial mechanical strength and toughness.

The outer cylinder 5 can consist of thin laminas 9, 10,11,12, of material having substantial resistance to brittle fracture and resistance to crack propagation through the several laminas.

A typical construction uses a strong and tough metal such as steel or wrought iron for at least the inner coaxial member 9 and the outer coaxial member 12.

The coaxial members 9,10,11,12, can comprise thin laminated steel and the tight-fitting laminas can be formed into an integral structure by explosive forming or heat-shrink-fitting.

Typically, at least one intermediate member 10 or 11 is a material that blocks deleterious penetration of nuclear particles therethrough; such as a mixture of at least one heat-conductive material like aluminum, copper, nickel, or a ferrous material, with at least one nuclear-particle blocking material like water, polyethylene, polypropylene, water-extended polyester, or other hydrogeneous material. Typically the heat-conductive material and the nuclear-particle-blocking material are substantially uniformly distributed in the mixture. Typically, the nuclear-particle-blocking material can be located in discrete zones within the heat conductive material and such zones are arrayed to block the radial emanation of neutrons while maintaining a continuous heat conductive material passage through the intermediate member.

Typically, at least one intermediate coaxial member 10 or 11 comprises a material that blocks any deleterious penetration of electromagnetic radiation therethrough such as cast iron.

In a typical embodiment of the invention, as shown in FIG. 1, an inner cylinder 6 forms a centrally located chimney 7, which provides supplemental cooling by air convection provided by cooler air entering at air ducts 8 in the bottom portion of the container 1. A thermally conductive spider 13 is provided in the chimney for increased heat transfer surface that may be formed integrally with the inner cylinder 6 or may be of a different metal that is held in close contact with the inner cylinder 6 by a shrink fit. As needed, the top opening of the chimney 7 can be provided in any well known manner with a spaced metallic cover or beam catcher not shown in the drawings.

The bottom portion 3 is welded to the outer cylinder 5 and the inner cylinder 6. The bottom surface 3 can be solid metal such as steel, wrought iron, or cast iron and provided with air cooling passages 8 in embodiments having a central chimney 7. An alternative to internal air passages 8, is to attach legs to the bottom surface 3 to raise said surface and allow cooling air to flow freely to the chimney 7. Typically the bottom portion 3 may comprise laminas similar to those used in the cylindrical wall 5. The laminar construction can be formed by welding the laminas or welding to the cylindrical wall, or by other means. A similar construction can be used for the cover 4, which can be bolted or welded to the adjacent portions of the container after loading with radioactive material. A double closure for the cover 4,4' as shown in FIG. 2 is sometimes desirable. Depending on the method of loading the radioactive material such as spent reactor fuel elements in the container, it may be desirable to provide liquid drains (not shown) in the bottom surface 3 to drain the annular fuel cavity 2.

While the forms of the invention herein disclosed constitute presently preferred embodiments, many others are possible. It is not intended herein to mention all of the possible equivalent forms or ramifications of the invention. It is to be understood that the terms used herein are merely descriptive rather than limiting, and that various changes may be made without departing from the spirit or scope of the invention.

We claim:

1. A cylindrical cask for nuclear reactor fuel comprising a bottom portion, a side portion, and a top portion, each portion comprising material for shielding against escape of electromagnetic radiation and nuclear particles and for transfer of heat as required, and the side portion comprising a plurality of predominantly metallic coaxial members, each fitting tightly against the next, and at least two of them having substantial mechanical strength and toughness wherein the coaxial members comprise explosive-formed or shrink-fitted laminas.

2. A cask as in claim 1, wherein the coaxial members comprise thin laminas of material having substantial resistance to brittle fracture.

3. A cask as in claim 1, wherein at least the inner and outer coaxial members comprise a strong and tough metal.

4. A cask as in claim 1, wherein at least the inner and outer coaxial members comprise steel.

5. A cask as in claim 1, wherein the coaxial members comprise thin laminated steel.

6. A cask as in claim 1, wherein the coaxial members include at least one intermediate member that blocks deleterious penetration of electromagn.etic radiation therethrough.

7. A cask as in claim 1, wherein the coaxial members include at least one intermediate member that blocks deleterious penetration of nuclear particles therethrough.

8. A cask as in claim 1, wherein the coaxial members include at least one intermediate member comprising a strong and tough metal for stopping the spread to it of any fracturing that might occur in an adjacent member.

9. A cask as in claim 1, wherein the inner coaxial member comprises a strong and tough material, an intermediate member comprises a material that blocks deleterious penetration of electromagnetic radiation therethrough, another intermediate member comprises a material that blocks deleterious penetration of nuclear particles therethrough, and the outer member comprises a strong and tough material.

10. A cask as in claim 1, wherein the inner coaxial member comprises steel or wrought iron, an intermediate member comprises cast iron, another intermediate member comprises a mixture of nuclear-particle-blocking material and heat-conductive material, in a predominantly metallic the outer member comprises steel or wrought iron.

11. A cask as in claim 10, wherein the nuclear-particle-blocking material comprises water, polyethylene, polyproplyene, water-extended polyester, or other hydrogeneous material, and the heat-conductive material comprise aluminum, copper, nickel, or a ferrous material.

12. A cask as in claim 11, wherein the nuclear-particle-blocking material and heat-conductive material are substantially uniformly distributed in the mixture.

13. A cask as in claim 1, wherein the fuel storage cavity is an annular space with an outer cylindrical side portion and an inner cylindrical side portion.

14. A cask as in claim 13, wherein the inner cylindrical side portion is air cooled by natural convection.

* * * * *